US010334915B2

(12) United States Patent
Vuille et al.

(10) Patent No.: US 10,334,915 B2
(45) Date of Patent: Jul. 2, 2019

(54) ATTACHMENT LINK

(71) Applicant: The Swatch Group Research and Development Ltd, Marin (CH)

(72) Inventors: Pierry Vuille, Les Emibois (CH); Jean-Claude Martin, Montmollin (CH)

(73) Assignee: The Swatch Group Research and Development Ltd, Marin (CH)

( * ) Notice: Subject to any disclaimer, the term of this patent is extended or adjusted under 35 U.S.C. 154(b) by 73 days.

(21) Appl. No.: 15/591,639

(22) Filed: May 10, 2017

(65) Prior Publication Data

US 2017/0325554 A1 Nov. 16, 2017

(30) Foreign Application Priority Data

May 16, 2016 (EP) ..... 16169783

(51) Int. Cl.

| | |
|---|---|
| ***A44C 5/00*** | (2006.01) |
| ***A44C 5/14*** | (2006.01) |
| ***A44C 5/02*** | (2006.01) |
| ***G04B 37/00*** | (2006.01) |
| ***G04B 37/14*** | (2006.01) |

(52) U.S. Cl.

CPC ..... *A44C 5/14* (2013.01); *A44C 5/0061* (2013.01); *A44C 5/027* (2013.01); *G04B 37/0008* (2013.01); *G04B 37/1493* (2013.01)

(58) Field of Classification Search

CPC ..... G04B 37/1486; A44C 5/14; A44C 5/00; A44C 5/027; A44C 5/0061; Y10T 24/4718

USPC ..... 24/265 WS

See application file for complete search history.

(56) References Cited

U.S. PATENT DOCUMENTS

| | | | | |
|---|---|---|---|---|
| 2,775,861 A | | 1/1957 | Fachon | |
| 6,036,359 A | * | 3/2000 | Pantet | A44C 5/022 368/281 |
| 2014/0098649 A1 | * | 4/2014 | Tschumi | G04B 37/1486 368/282 |
| 2015/0342308 A1 | * | 12/2015 | Wilson | A45F 5/00 224/219 |

FOREIGN PATENT DOCUMENTS

| | | |
|---|---|---|
| CH | 707 071 A2 | 4/2014 |
| CH | 707 523 A2 | 7/2014 |

OTHER PUBLICATIONS

European Search Report dated Oct. 18, 2016 in European application 16169783.4, filed on May 16, 2016 (with English Translation of Categories Cited Documents).

* cited by examiner

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

An attachment link for a watch band is arranged to attach the band to a watch case between the horns. A first end of the attachment link is fixed to a watch band strand and the second end of the attachment link is fixed to the case with a bar. The link is between the horns and against the case. The attachment link includes a device for blocking pivoting in order to firmly hold the attachment link between the horns.

14 Claims, 2 Drawing Sheets

ATTACHMENT LINK

This application claims priority from European Patent Application No. 16169783.4 filed on May 16, 2016; the entire disclosure of which are incorporated herein by reference.

FIELD OF THE INVENTION

The present invention relates to a device for attaching a watch band to a watch case comprising covering elements made from a hard material such as metal. More specifically, the present invention relates to an attachment link provided to attach a watch band to a case of a watch.

BACKGROUND OF THE INVENTION

Watches that are held on the wrist of the user by means of a band are known in the prior art. This band can be made of leather, fabric, rubber, ceramic or also of metal and is attached to the horns of the watch by means of bars fixed between the horns, for example.

Depending on the band used by the wearer, the case of the watch can be visible at the space between the horns. In fact, if the user wishes to change his/her metal watch band, which is generally inserted into the space between the horns, with a rubber, leather or fabric watch band, the case becomes visible.

A disadvantage is that the metal or ceramic link forming the connection between the case and the band can pivot around the bar holding the link in the space between the horns and this can ruin the case and spoil the aesthetics of the watch when changing the band to a different type of band. Therefore, current methods of fixture are not satisfactory from an aesthetic viewpoint once made visible, and this can, moreover give the impression of a poor join or of poor workmanship.

SUMMARY OF THE INVENTION

The object of the invention in particular is to remedy the different disadvantages of these known techniques.

More precisely, an object of the invention is to block, or at the very least contain, the movement of the attachment link between the case and the band in order in particular to protect the case from any wear or deterioration.

These objects, as well as others that will become clearer below, are achieved according to the invention by means of an attachment link for a watch band arranged to attach the band to a watch case between the horns, wherein a first end of the attachment link is fixed to a watch band strand and the second end of the attachment link is fixed to the case by means of a bar, for example, the link being between the horns and against the case or at the very least as close as possible to the case.

According to the invention the attachment link comprises means for blocking pivoting in order to firmly hold the attachment link between the horns and against the case.

In accordance with other advantageous variants of the invention:

- the blocking means comprise at least one blocking element projecting at the level of the end in contact with the case;
- the blocking means comprise at least one blocking element projecting at the level of the end in contact with the horns;

- the at least one blocking element is made from an elastically deformable material such as rubber;
- the at least one blocking element is made from a hard material such as a metal, ceramic, composite or also plastic material;
- the at least one blocking element is integrated into the link;
- the at least one blocking element is moulded onto the link;
- the link is made from a metal, ceramic, composite or also plastic material;
- the watch band strand is made from leather, rubber, synthetic material, fabric, ceramic or metal.

The invention also and in particular relates to any timepiece comprising at least one attachment link according to the invention.

BRIEF DESCRIPTION OF THE DRAWINGS

Other characteristics and advantages of the invention will become clearer on reading the following description of a particular embodiment of the invention given as a simple non-restrictive illustrative example and of the attached figures, wherein.

DETAILED DESCRIPTION OF THE PREFERRED EMBODIMENTS

The invention relates to an attachment link for a watch band arranged to attach the band to a watch case between the horns, wherein a first end of the attachment link is fixed to a watch band strand and the second end of the attachment link is fixed to the case by means of a bar, for example, the link being between the two horns and against the case.

Figure 1:
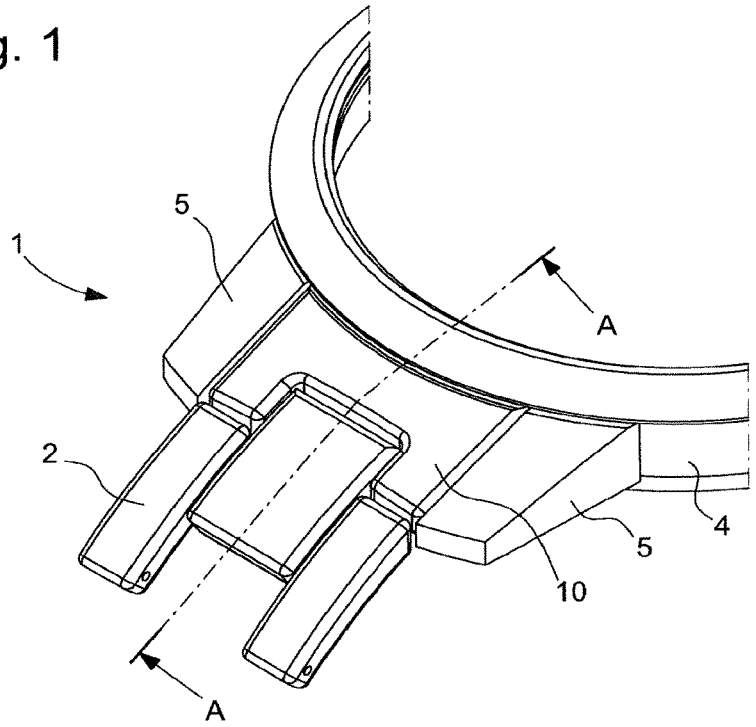
FIG. 1 is a perspective view of a watch fitted with an attachment link according to the invention.
Figure 2:
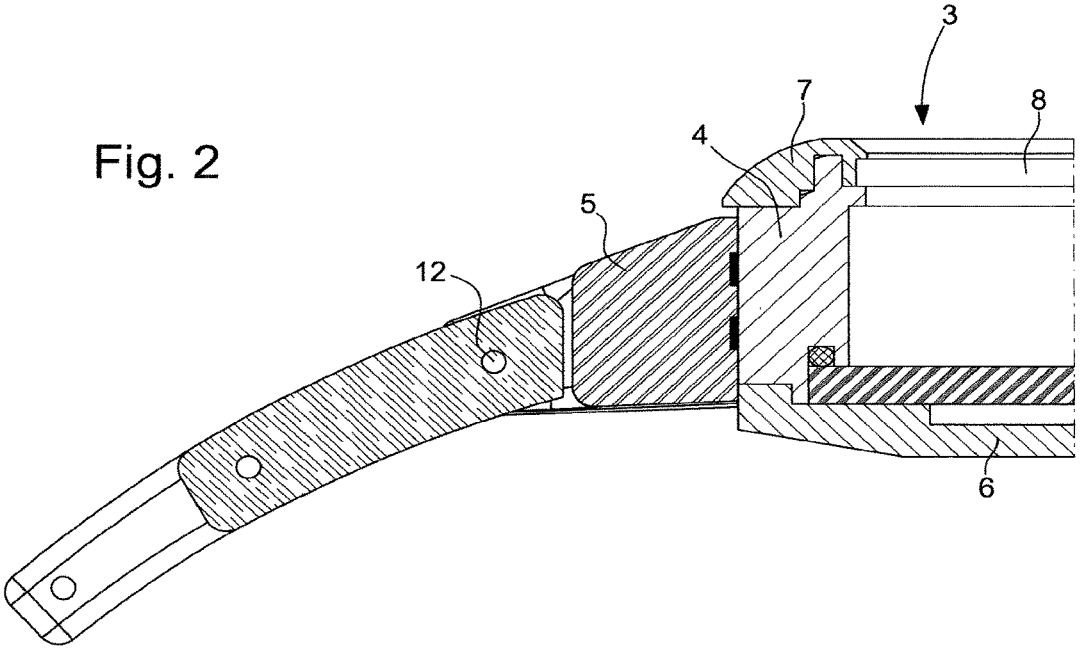
FIG. 2 is a sectional view taken along line A-A of FIG. 1.

According to the invention the attachment link comprises means for blocking pivoting in order to firmly hold the attachment link between the horns. FIGS. 1 and 2 show a wrist watch 1 comprising a portion of a linked band 2 attached to a watch case 3. The watch case 3 comprises a middle part 4 elongated in the longitudinal direction of the watch band by horns 5 pierced by a hole 50. The watch case 3 is classically delimited at the bottom by a base 6 and at the top by a bezel 7 and a watch glass 8.

The attachment link 10 according to the invention is provided in the form of a body in one piece having a front face, referred to as the first end 101, a rear face, referred to as the second end 100, two side faces 102, an upper face and a lower face.

The attachment link 10 comprises a first hollow element such as a bore 11 arranged to receive a bar 12 to enable the attachment link 10 to be fixed between the two horns 5. This attachment link 10 is provided to attach a watch band strand to the middle part 4 of the watch case 3. According to the illustrated embodiment the bar 12 fixes the watch band strand to the attachment link 10 and the attachment link 10 to the horns 5. According to a variant a first bar can fix the attachment link 10 to the horns 5 and a second bar can attach the watch band strand to the attachment link 10.

According to the invention the attachment link 10 comprises means for blocking pivoting around the axis formed by the bar 12 in order to firmly hold the attachment link 10 between the horns 5 and against the middle part 4.

According to a first embodiment the means for blocking pivoting comprise at least a first blocking element 13 projecting at the level of the rear face 100 of the attachment link 10, wherein the at least one blocking element 13 is in contact with the middle part 4 when the link 10 is arranged between the horns 5 and prevents any play between the link 10 and the case 3 after assembly.

According to a second embodiment the means for blocking pivoting comprise at least one second blocking element 14 projecting at the level of the side faces 102 of the attachment link 10, wherein the second blocking element 14 is in contact with the horns 5 when the link 10 is arranged between the horns 5 and prevents any play between the link 10 and the case 3 after assembly.

Figure 3:
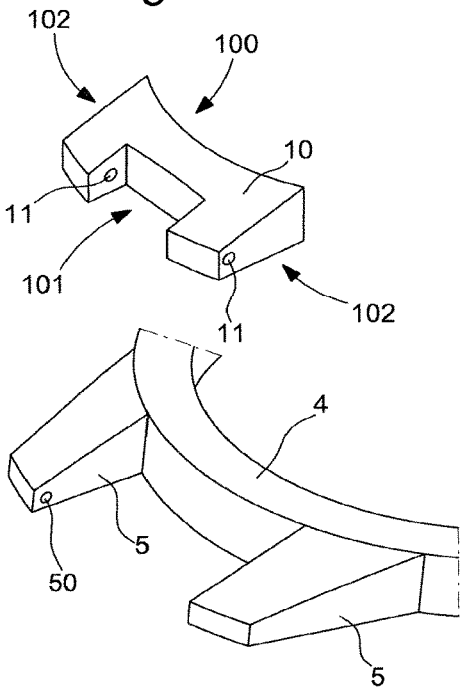
FIG. 3 is a perspective view of an attachment link according to the invention.
Figure 4:
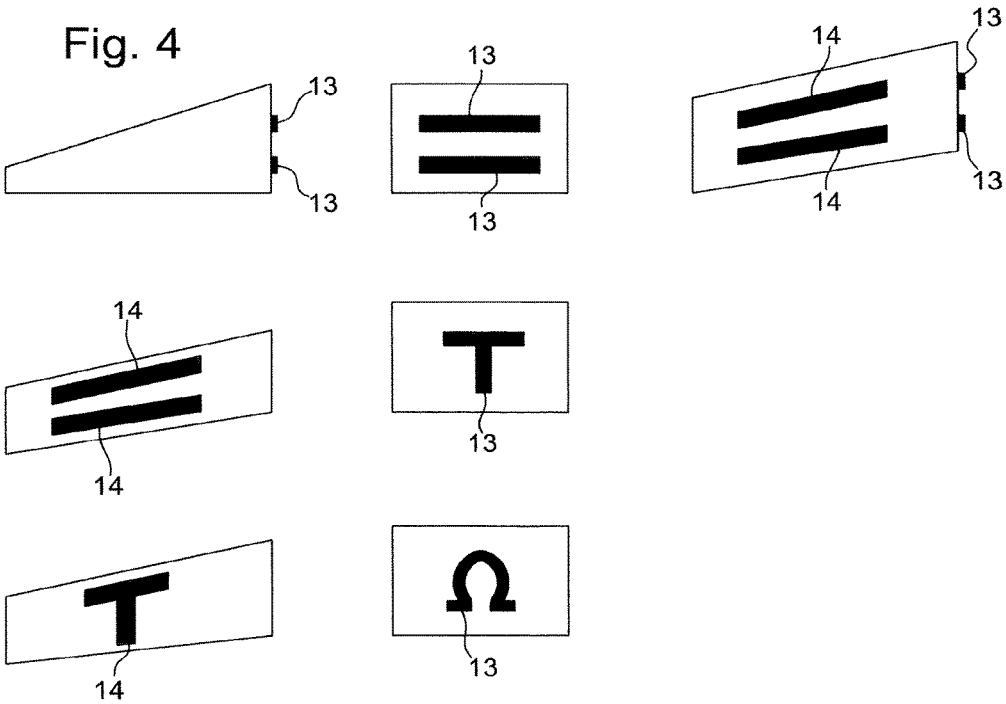
FIG. 4 shows the different possible variants of an attachment link according to the invention.

As illustrated in FIGS. 3 and 4, the first and second blocking elements 13 and 14 are provided in the form of an insert made from an elastically deformable material such as an elastomeric material like rubber. The inserts can be formed directly with the link or be moulded onto this. It is also possible to provide a negative working in the link to receive the inserts, wherein the latter are then forced into the negative working or workings.

The link can have one or more generally rectangular inserts arranged along the length or depth of the link 10, wherein the length of the insert or inserts is slightly less than the length and/or depth of the link. Length of the link is understood to mean the length of the rear face 100 and depth of the link is understood to mean the length of the side face 102.

According to another embodiment the first and second blocking elements 13 and 14 can be made from a hard material such as metal, ceramic or also plastic material. Advantageously, the blocking elements can be made in one piece with the attachment link 10 and in the same material, e.g. from metal or also from ceramic.

It is also conceivable that the blocking elements are provided in the form of a letter or logo, e.g. a "T" or an "Ω".

To enable the watch band strand to be fixed to the attachment link 10, the latter can comprise a passage, through which the bar passes, wherein the passage is suitable for receiving a watch band strand or a link.

For assembly of the attachment link 10 on the watch case 3, the watch band strand is firstly inserted into the passage of the link 10, then the bar is slid through the bore 11 pierced into the link. The attachment link is then inserted between the horns 5 so that a first end of the bar is accommodated in a hole 50 of a horn 5. After this, the link 10 is slid between the horns 5 of the watch case 3, ensuring that the second end of the bar is engaged in the hole 50 of the opposite horn 5. When this step of the assembly is completed, the blocking elements 13 and/or 14 are pressed between the case 3 and the link 10, and this enables any play between these two elements to be compensated and the movement of the link 10 to thus be limited or indeed blocked.

The watch band can be composed of watch band strands made, for example, from a flexible material such as rubber or silicone, or also leather, but also metal, ceramic or also a composite. Such an attachment link 10 allows a better hold between the horns 5 as well as a better placement of the watch band strand without having to modify its hold in the case 3. It also allows a very pure aesthetic between the watch band attachment and the case without any awkward and variable play between one part and the other in accordance with machining and assembly tolerances.

Figure 5:
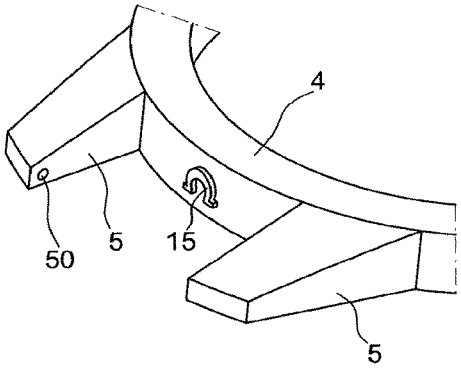
FIG. 5 is a perspective view of a middle part having means for blocking the link according to another embodiment.

Clearly, a person skilled in the art will be able to envisage positioning the blocking means at the level of the middle part on the case band between the horns 5 in order to block the attachment link 10, wherein the middle part can receive the same blocking means as the attachment link. As illustrated in FIG. 5, the watch comprises a blocking element 15 provided in an "Ω" shape and the blocking element can be machined at the same time as the middle part or subsequently added to the middle part in the case of an insert.

As a result of such an arrangement it is thus possible to be able to see the case band and also see the blocking means when the type of watch band is changed, e.g. a metal band changed with a traditional leather band. This is particularly advantageous when the blocking means are in the form of a decorative element such as a logo.

It is clear that the present invention is not limited to the embodiment that has just been described and various simple modifications and variants can be envisaged by a person skilled in the art without departing from the framework of the invention as defined by the attached claims of the present patent application. In particular, it will be understood that although it has been described in association with a watch band link and a watch case made from metal material, the present invention can be applied in an identical manner to links and cases made from another hard material such as ceramic, a composite or also plastic materials.

What is claimed is:

1. An attachment link for a watch band arranged to attach the band to a watch case between horns, wherein the attachment link is U-shaped with two arms extending out from a base, wherein a first end of the attachment link is fixed to a watch band strand between the two arms and a second end of the attachment link is formed by the bottom face of the base and is arranged to be against the case, wherein the attachment link is positioned between the horns against the case and held with a bar, wherein the attachment link comprises means for blocking pivoting in order to firmly hold the attachment link between the horns and against the case, the blocking means comprising at least one of:

a first blocking element mounted on the bottom face of the base of the attachment link and projecting outward from the bottom face towards the case, and a second blocking element mounted on an outside face of each of the two arms of the attachment link and projecting outward from the outside face towards the horns.

2. The attachment link according to claim 1, wherein the first and/or the second blocking element are made from an elastically deformable material.

3. The attachment link according to claim 1, wherein the first and/or the second blocking element are made from a hard material.

4. The attachment link according to claim 1, wherein the first and/or the second blocking element are integrated into the attachment link.

5. The attachment link according to claim 1, wherein the first and/or the second blocking element are moulded onto the attachment link.

6. The attachment link according to claim 1, wherein the first and/or the second blocking element are made in the form of a logo.

7. The attachment link according to claim 1, wherein the attachment link is made from a hard material.

8. A watch comprising:

a case formed by a middle part having two pairs of horns defining a space for attachment to the middle part and comprising at least one attachment link according to claim 1, wherein the attachment link is accommodated in the attachment space.

9. The watch according to claim 8, wherein the watch band strand is made from leather, rubber, fabric, synthetic material, ceramic, composite or metal.

10. The watch according to claim 8, wherein the watch band is positioned between the two arms of the attachment link.

11. The attachment link according to claim 1, wherein the attachment link is made from a metal, ceramic, composite or plastic material.

12. The attachment link according to claim 1, wherein the first and/or the second blocking element are made from an elastomeric material.

13. The attachment link according to claim 1, wherein the first and/or the second blocking element are made from a metal, ceramic, composite or plastic material.

14. The attachment link according to claim 1, wherein each of the two arms of the attachment link includes a bore to receive the bar.

* * * * *